US010152012B2

(12) United States Patent
Yoshida et al.

(10) Patent No.: US 10,152,012 B2
(45) Date of Patent: Dec. 11, 2018

(54) SHEET CONVEYING APPARATUS AND IMAGE FORMING APPARATUS

(71) Applicant: CANON KABUSHIKI KAISHA, Tokyo (JP)

(72) Inventors: Atsushi Yoshida, Abiko (JP); Takayuki Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 15/256,993

(22) Filed: Sep. 6, 2016

(65) Prior Publication Data

US 2017/0075285 A1 Mar. 16, 2017

(30) Foreign Application Priority Data

Sep. 14, 2015 (JP) ..... 2015-180361

(51) Int. Cl.
*G03G 15/00* (2006.01)
*G03G 21/16* (2006.01)
(Continued)

(52) U.S. Cl.
CPC ..... *G03G 15/70* (2013.01); *B65H 29/125* (2013.01); *G03G 21/1638* (2013.01);
(Continued)

(58) Field of Classification Search
CPC ..... G03G 15/70; G03G 15/6573; G03G 15/6579; G03G 21/1638;
(Continued)

(56) References Cited

U.S. PATENT DOCUMENTS 4,862,215 A * 8/1989 Nomura ..... G03G 15/657 162/271
4,878,656 A 11/1989 Honjo et al.
(Continued)

FOREIGN PATENT DOCUMENTS

CN 1661487 A 8/2005
CN 101081668 A 12/2007
(Continued)

OTHER PUBLICATIONS

Aug. 1, 2018 Chinese Official Action in Chinese Patent Appln. No. 201610815743.3.

*Primary Examiner* — Jennifer Simmons
*Assistant Examiner* — Quang X Nguyen
(74) *Attorney, Agent, or Firm* — Fitzpatrick, Cella, Harper & Scinto

(57) ABSTRACT

A sheet conveying apparatus includes: a drawer portion that includes a pair of conveying rollers which convey a sheet; a conveying portion that includes a pair of separating rollers which convey the sheet; and a controller that controls operations of the drawer portion and the conveying portion such that, the pair of separating rollers are separated from each other if a jam of a sheet occurs in a state in which a subsequent sheet subsequent to a preceding sheet spans the drawer portion and the conveying portion, the pair of conveying rollers convey the subsequent sheet to a part between the pair of separating rollers, the separation of the pair of separating rollers is released, and the pair of separating rollers convey the subsequent sheet along with the preceding sheet to a position at which the subsequent sheet does not span the drawer portion and the conveying portion using.

17 Claims, 18 Drawing Sheets

(51) Int. Cl.
*B65H 29/12* (2006.01)
*B65H 85/00* (2006.01)

(52) U.S. Cl.
CPC .... *B65H 85/00* (2013.01); *B65H 2301/33312* (2013.01); *B65H 2402/10* (2013.01); *B65H 2404/144* (2013.01); *B65H 2601/11* (2013.01); *B65H 2801/06* (2013.01); *G03G 2215/0054* (2013.01); *G03G 2215/00544* (2013.01); *G03G 2221/1684* (2013.01)

(58) Field of Classification Search
CPC . G03G 2215/0054; G03G 2215/00544; G03G 2215/00548; G03G 2215/00552; B65H 29/125
See application file for complete search history.

(56) References Cited

U.S. PATENT DOCUMENTS

| | | | |
|---|---|---|---|
| 5,018,716 | A | 5/1991 | Yoshida et al. |
| 5,105,225 | A | 4/1992 | Honjo et al. |
| 5,348,283 | A | 9/1994 | Yanagi et al. |
| 5,370,380 | A | 12/1994 | Suzuki et al. |
| 5,442,431 | A | 8/1995 | Fujimoto et al. |
| 5,620,174 | A | 4/1997 | Yaniguro et al. |
| 5,655,765 | A | 8/1997 | Asami et al. |
| 6,098,977 | A | 8/2000 | Sato et al. |
| 6,168,270 | B1 | 1/2001 | Saikawa et al. |
| 6,731,903 | B2 | 5/2004 | Suzuki |
| 6,792,241 | B2 | 9/2004 | Nakagawa et al. |
| 6,845,228 | B2 | 1/2005 | Suzuki et al. |
| 6,908,078 | B2 | 6/2005 | Suzuki et al. |
| 7,080,830 | B2 | 7/2006 | Suzuki et al. |
| 7,354,034 | B2 | 4/2008 | Nakamura et al. |
| 7,434,802 | B2 | 10/2008 | Yamamoto |
| 7,543,806 | B2 | 6/2009 | Nakamura et al. |
| 7,708,276 | B2 | 5/2010 | Okamoto et al. |
| 8,814,162 | B2 | 8/2014 | Suzuki |
| 8,851,661 | B2 | 10/2014 | Iijima |
| 8,991,824 | B2 | 3/2015 | Suzuki |
| 2005/0206069 | A1 | 9/2005 | Yamamoto |
| 2008/0001350 | A1 | 1/2008 | Okamoto et al. |
| 2010/0034559 | A1* | 2/2010 | Sahara ..... G03G 15/6579 399/122 |
| 2013/0083146 | A1 | 4/2013 | Iijima |
| 2014/0159303 | A1 | 6/2014 | Suzuki |
| 2016/0334750 | A1* | 11/2016 | Nakagaki ..... G03G 15/70 |

FOREIGN PATENT DOCUMENTS

| | | | |
|---|---|---|---|
| CN | 103030017 | A | 4/2013 |
| CN | 103863587 | A | 6/2014 |
| EP | 0536778 | A1 | 4/1993 |
| JP | 05-97305 | A | 4/1993 |
| JP | H06-191702 | A | 7/1994 |
| JP | 11-227985 | A | 8/1999 |
| JP | 3010091 | B2 | 2/2000 |

* cited by examiner

SHEET CONVEYING APPARATUS AND IMAGE FORMING APPARATUS

BACKGROUND OF THE INVENTION

Field of the Invention

The present invention relates to a sheet conveying apparatus including a drawer portion that includes a pair of conveying rollers which convey a sheet and that is drawable from an apparatus body and an image forming apparatus including the sheet conveying apparatus.

Description of the Related Art

In an image forming apparatus according to the related art, a configuration including a drawer portion that can be drawn by a user so as to process a sheet in a conveying path is used to remove a sheet remaining in the conveying path when a jam occurs during conveyance of a sheet. However, when a sheet spanning the drawer portion and another portion is present at the time of occurrence of the jam and the drawer portion is drawn, there is a problem in that the sheet is torn and a part of the sheet remains in the conveying path and serves as conveyance resistance of the next sheet to cause a jam again. In particular, when a sheet spanning the drawer portion and a reverse conveying portion inverting front and rear sides of a sheet is present and the drawer portion is drawn, the spanning sheet may be torn to damage a fixing film or non-fixed toner may be scattered in the apparatus.

Therefore, since the sheet spans the drawer portion and another portion as described above, the following configurations have been proposed for the problem in that the sheet is torn in the related art. A configuration in which a sheet spanning a drawer portion and another portion is conveyed to a non-spanning position is disclosed in Japanese Patent Laid-Open No. H5-97305. A configuration in which a leading edge of a sheet does not move but only a trailing edge is conveyed and the sheet is pressed into a space in a conveying path is disclosed in Japanese Patent Laid-Open No. H11-227985.

However, when a jam occurs in a state in which a sheet spans a drawer portion and a reverse conveying portion and a source of the jam is located downstream in a conveying direction from the reverse conveying portion, the sheet spanning the drawer portion and the reverse conveying portion cannot retract downstream in the conveying direction. That is, when the sheet causing the jam downstream is conveyed to enable the spanning sheet to retract, there is a possibility that the sheet causing the jam will be torn at the time of moving into a rib, a flapper, or a roller. Accordingly, the spanning sheet cannot retract downstream in the conveying direction (to the reverse conveying portion side) in the drawer portion. In the configuration disclosed in Japanese Patent Laid-Open No. H11-227985, there is a space for receiving deflection of a sheet when the sheet is forcibly conveyed, but the reverse conveying portion has no space into which the forcibly conveyed sheet is pressed since a gap between guides is small. Accordingly, since there is a possibility that a crease will be generated in the sheet to cause an insufficient conveying torque or there is a possibility that the sheet will be damaged and broken by pressing the sheet, the sheet cannot be forcibly conveyed to retract from the drawer portion.

SUMMARY OF THE INVENTION

Therefore, it is desirable to process a sheet spanning a drawer portion and a reverse conveying portion without being broken and to suppress conveyance of a sheet preceding the sheet spanning the drawer portion and the reverse conveying portion to prevent damage of the sheet subsequent to the preceding sheet.

In order to solve the above issue, according to the present invention, a sheet conveying apparatus includes: A sheet conveying apparatus comprising: a drawer portion that includes a pair of conveying rollers which convey a sheet and that is drawable from an apparatus body; a conveying portion that includes a pair of separating rollers which convey the sheet received from the drawer portion by positive rotation or reverse rotation and which come in contact with and are separated from each other, the conveying portion being disposed in the apparatus body; and a controller that controls operations of the drawer portion and the conveying portion such that, the pair of separating rollers are separated from each other if a jam of a sheet occurs in a state in which a preceding sheet is nipped by the pair of separating rollers and a subsequent sheet subsequent to the preceding sheet spans the drawer portion and the conveying portion, the pair of conveying rollers convey the subsequent sheet to a part between the pair of separating rollers, the separation of the pair of separating rollers is released, and the pair of separating rollers convey the subsequent sheet along with the preceding sheet to a position at which the subsequent sheet does not span the drawer portion and the conveying portion using.

According to the present invention, it is possible to suppress conveyance of a preceding sheet to prevent a crease or damage of a sheet and to prevent damage of a sheet due to drawing of the drawer portion, when a jam of the sheet occurs.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the accompanying drawings. Dimensions, materials, and shapes of constituent elements described in the following embodiments, relative arrangements thereof, and the like will be appropriately changed depending on the configuration of an apparatus to which the present invention is applied or various conditions. Accordingly, unless described specifically, it is not intended to limit the scope of the present invention thereto.

Figure 1:
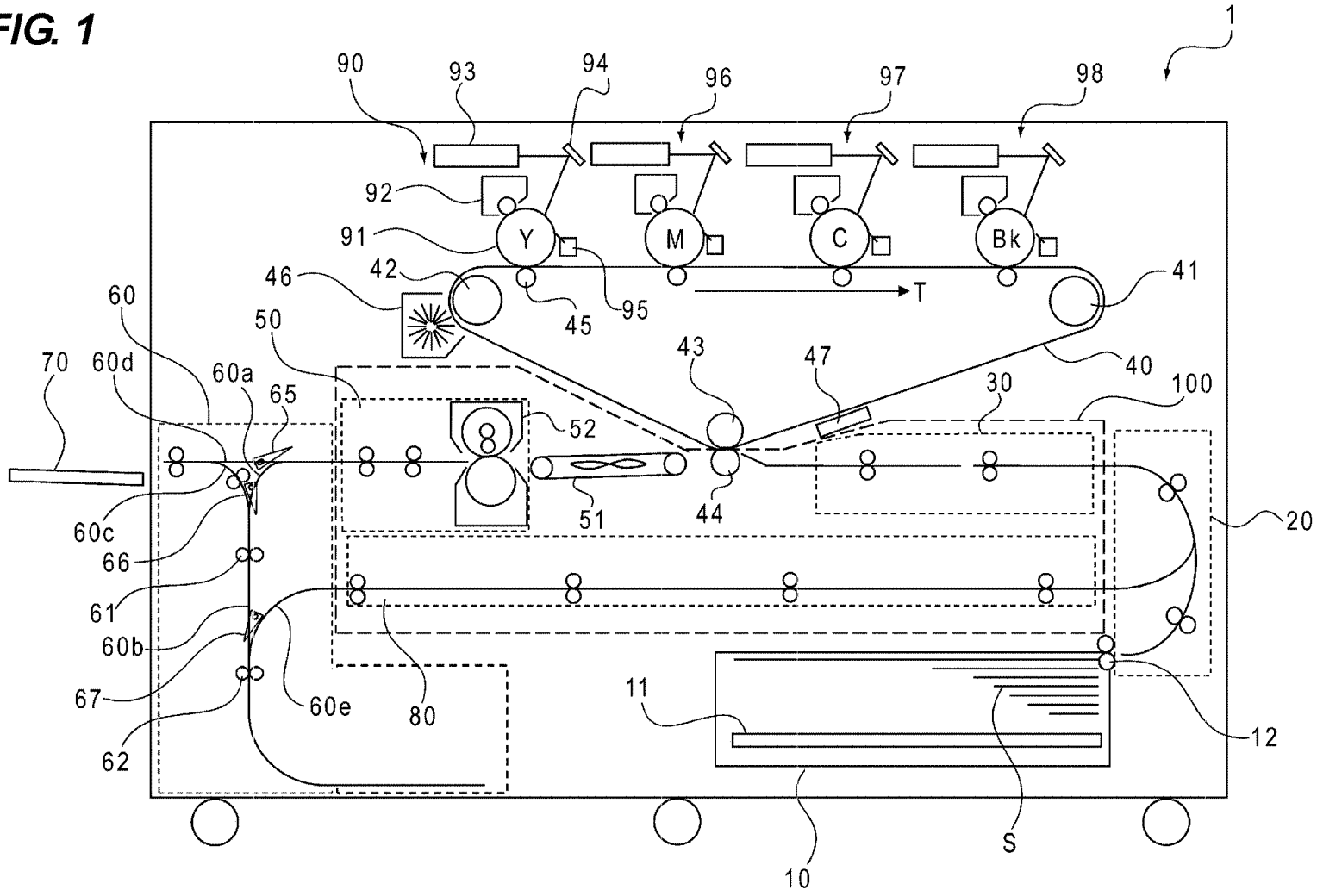
FIG. 1 is a schematic cross-sectional view of an image forming apparatus.

The entire configuration of an image forming apparatus including a sheet conveying apparatus according to an embodiment of the present invention will be described below with reference to FIG. 1. FIG. 1 is a cross-sectional view of an image forming apparatus including a sheet conveying apparatus.

An image forming apparatus 1 includes a drawer portion 100 that is drawable from an apparatus body and a reverse conveying portion 60 that inverts front and rear sides of a sheet received from the drawer portion and that conveys the inverted sheet as a sheet conveying apparatus. The drawer portion 100 and the reverse conveying portion 60 will be described later in detail.

A sheet B as a transfer medium is received on a lift-up unit 11 of a feed unit 10 in a piled manner and is fed sheet by sheet in synchronization with an image forming timing of the image forming apparatus 1 by a feed portion 12. Here, the feed portion 12 employs a method using frictional separation by a separating roller or the like. The sheet B fed by the feed portion 12 passes through a conveying path of a conveying unit 20 and is conveyed to a registration unit 30. The sheet B is subjected to skew feeding correction or timing correction by the registration unit 30 and is fed to a secondary transfer portion. The secondary transfer portion is a toner image transfer nip portion to the sheet B, which is formed by a secondary transfer inner roller 43 and a secondary transfer outer roller 44 which substantially face each other, and transfers a toner image to the sheet B by applying a predetermined pressure and an electrostatic load bias.

In the above-mentioned process of conveying the sheet B to the secondary transfer portion, an image forming process of sending the sheet to the secondary transfer portion at the same timing will be described below. An image forming portion 90 mainly includes a photosensitive member 91, an exposure unit 93, a developing unit 92, a primary transfer unit 45, and a photosensitive member cleaner 95, for example. The exposure unit 93 emits light to the photosensitive member 91 of which the surface is uniformly charged in advance by a charging unit and which rotates counterclockwise on the basis of a signal of supplied image information to form a latent image appropriately via a reflecting portion 94 and the like. The electrostatic latent image formed on the photosensitive member 91 in this way is subjected to toner development by the developing unit 92 to form a toner image on the photosensitive member. Thereafter, a predetermined pressure and an electrostatic load bias are applied thereto by the primary transfer unit 45 and the toner image is transferred onto an intermediate transfer belt 40. Thereafter, residual toner remaining on the photosensitive member 91 is recovered by the photosensitive member cleaner 95 and next image formation is ready.

The above-mentioned image forming portion 90 includes total four sets of a magenta (M) image forming portion 96, a cyan (C) image forming portion 97, and a black (Bk) image forming portion 98 in addition to the yellow (Y) image forming portion 90 in FIG. 1. The image forming portion is not limited to four colors, and the color arrangement order thereof is not limited thereto.

The intermediate transfer belt 40 will be described below. The intermediate transfer belt 40 is suspended by rollers such as a driving roller 42, a tension roller 41, and a secondary transfer inner roller 43 and is rotationally driven in the direction of an arrow T in the drawing. Accordingly, image forming processes by colors which are performed in parallel by the image forming portions of Y, M, C, and Bk are performed at timings at which the image forming portions are superimposed on the toner image which is primarily transferred onto the intermediate transfer belt and located upstream in the conveying direction. As a result, a full-color toner image is finally formed on the intermediate transfer belt 40 and is conveyed to the secondary transfer portion.

The full-color toner image is secondarily transferred onto a sheet B in the secondary transfer portion by the conveying process of the sheet B and the image forming process, which are described above. Thereafter, the sheet B is conveyed to a fixing unit 52 by a pre-fixing conveying portion 51. The fixing unit 52 melts and fixes toner onto the sheet B using a predetermined pressure by a substantially facing roller or belt and a heating effect generally based on a heat source such as a halogen heater together. The sheet B having a fixed image acquired in this way is conveyed to a reverse guide path 60*a* and is drawn into a switchback path 60*b* such that the page order is not reversed when the sheet is discharged onto a discharge tray 70. Here, a reversing flapper 66 as a reverse switching member serves to switch the conveying path to the reverse guide path 60*a* as a first conveying path and a reverse discharge path 60*c* as a second conveying path different from the first conveying path. A reversing flapper biasing spring 125 (see FIG. 12) as a reverse biasing member normally applies a force to the reversing flapper 66 so as to form a conveying path in the reverse discharge path 60*c*. Accordingly, the sheet conveyed from the reverse guide path 60*a* to the switchback path 60*b* is conveyed against a biasing force of the reversing flapper 66 with a sheet conveying force. By switching a rotation direction of the pair of separating rollers 61 to a positive direction and a reverse direction (so-called a switchback operation), the leading and trailing edges of the sheet are reversed and the sheet passes through the reverse discharge path 60*c* and is discharged onto the discharge tray 70 with an image surface downward.

The pair of separating rollers 61 are disposed to come in contact with and be separated from each other. Here, the pair of separating rollers 61 are configured to be separated by a separating portion to be described later and come in contact with each other by releasing the separation by the separating portion. The separation of the pair of separating rollers 61 means that a first roller and a second roller of the pair of separating rollers 61 are separated from each other.

A conveying operation when duplex image formation is required will be described below. The leading edge and the trailing edge of the sheet B fed to the reverse conveying portion 60 are reversed by a switchback operation to invert the front and rear sides of the sheet. At this time, a duplex flapper 67 as a duplex switching member serves to switch the conveying path to the switchback path 60*b* as a third conveying path and a duplex conveying path 60*e* as a fourth conveying path different from the third conveying path. A duplex flapper biasing spring 129 (see FIG. 12) as a duplex biasing member normally applies a force to the duplex flapper 67 so as to form a conveying path in the duplex conveying path 60*e*. Accordingly, the sheet guided downward in the switchback path 60*b* is conveyed against a biasing force of the duplex flapper 67 with a sheet conveying force. When a duplex image is formed, the sheet is conveyed again to the image forming portion through the duplex conveying path 60*e* and a duplex conveying portion 80 after the switchback operation. Thereafter, the sheet is merged from a re-feed path of the conveying unit 20 in synchronization with a sheet B of the subsequent job conveyed from the feed unit 10 and is similarly fed to the secondary transfer portion. The image forming process is the same as that for the first surface. As a difference from that for the first surface, since the sheet passes through a straight path 60*d* in the reverse conveying portion 60, a switching flapper 65 as a switching member is switched to convey the sheet to the straight path 60*d*. A force is normally applied to the switching flapper 65 to form a path in the reverse guide path 60*a* and switches the path using a switching portion which is not illustrated only when the sheet is conveyed to the straight path 60*d*. At the time of duplex image formation, the sheet B is discharged to the discharge tray 70 through the straight path 60*d* such that the page order is not reversed.

The above-mentioned series of image forming processes in the image forming portions end and a next image forming operation can be prepared.

In this embodiment, the drawer portion 100 is drawable from an apparatus body of the image forming apparatus by a user so as to easily process the sheet remaining in the image forming portion when a jam occurs. The drawer portion 100 includes the registration unit 30, the secondary transfer outer roller 44, the pre-fixing conveying portion 51, the fixing portion 50, and the duplex conveying portion 80.

Figure 2:
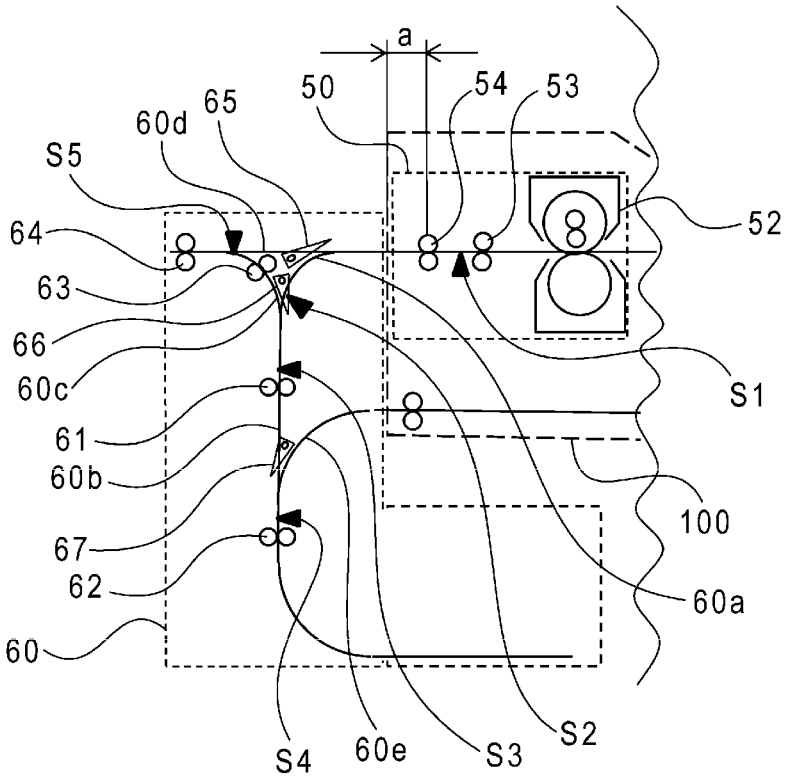
FIG. 2 is a schematic diagram of a reversing portion.
Figure 3A:
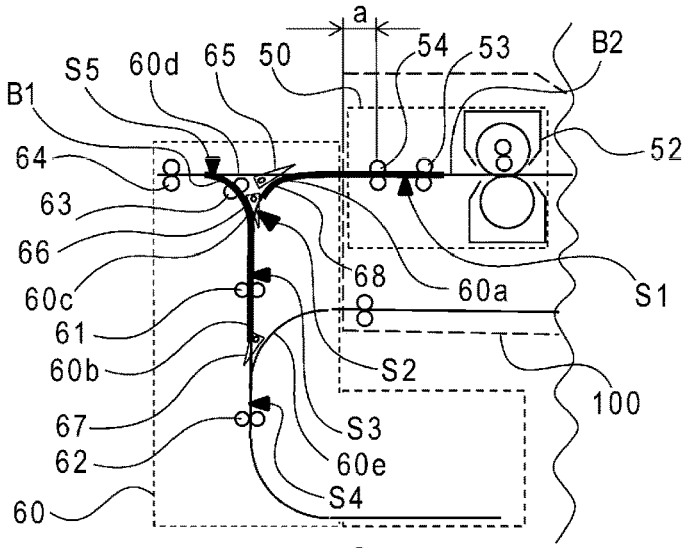
FIGS. 3A, 3B, and 3C are schematic diagrams illustrating a conveying operation in an embodiment of the present invention.

Subsequently, the conveying operation of the reverse conveying portion 60 in the image forming operation on plural sheets will be described in detail. FIG. 2 is a schematic diagram of the reverse conveying portion 60 and FIG. 3A illustrates an example of sheets which are conveyed in the reverse conveying portion. When the image forming operation is performed on plural sheets, a gap between sheets is shortened to enhance productivity and, for example, the gap between sheets is set to substantially 30 [mm] for sheets of A4. In order to avoid a decrease in productivity because a subsequent sheet B2 waits for switchback of a preceding sheet B1 in the reverse conveying portion 60, the sheets are conveyed while being adjusted in the switchback operation. Here, sheets of A4 will be exemplified to be conveyed.

In the reverse conveying portion 60, a sheet B1 which precedes (hereinafter referred to as preceding sheet B1) is conveyed to the switchback path 60*b*, and the pair of separating rollers 61 reversely rotate to feed the preceding sheet B1 to the reverse discharge path 60*c* after the trailing edge of the preceding sheet B1 passes through the reverse guide path 60*a*. On the other hand, a sheet B2 which is subsequent to the preceding sheet B1 (hereinafter referred to as subsequent sheet B2) is drawn to the switchback path 60*b* from the reverse guide path 60*a* and is conveyed to get rubbed against the preceding sheet B1. Subsequently, before the subsequent sheet B2 reaches the pair of separating rollers 61, the preceding sheet B1 is nipped by a pair of first discharge rollers 63, the pair of separating rollers 61 are separated by the separating portion, and the subsequent sheet B2 is conveyed downward in the switchback path 60*b* between the pair of separated separating rollers 61 while getting rubbed against the preceding sheet B1. When the preceding sheet B1 passes through the pair of separating rollers 61, the separation of the pair of separating rollers 61 is released to nip the subsequent sheet B2 and the subsequent sheet B2 is conveyed in the same path as the preceding sheet B1. The same conveying process is performed on sheets with different sizes. As a difference from the A4 size, the position at which the leading edge of a sheet reaches a downside of the switchback path 60*b* varies.

Here, sensors S1 to S5 are sheet detectors that detect a sheet. A controller C illustrated in FIG. 5 detects a position of a sheet, passage of the sheet, and a jam of the sheet on the basis of signals from the sensors. The sensor S1 is disposed downstream in the conveying direction in the vicinity of a pair of first inner discharge rollers 53. The sensor S2 is disposed upstream in the conveying direction from the reversing flapper 66 in the reverse guide path 60*a*. The sensor S3 is disposed upstream in the conveying direction in the vicinity of the pair of separating rollers 61. The sensor S4 is disposed on an inlet side of the switchback path 60*b* in the vicinity of the pair of reversing rollers 62. The sensor S5 is disposed downstream in the conveying direction in the vicinity of a pair of first discharge rollers 63.

Figure 5:
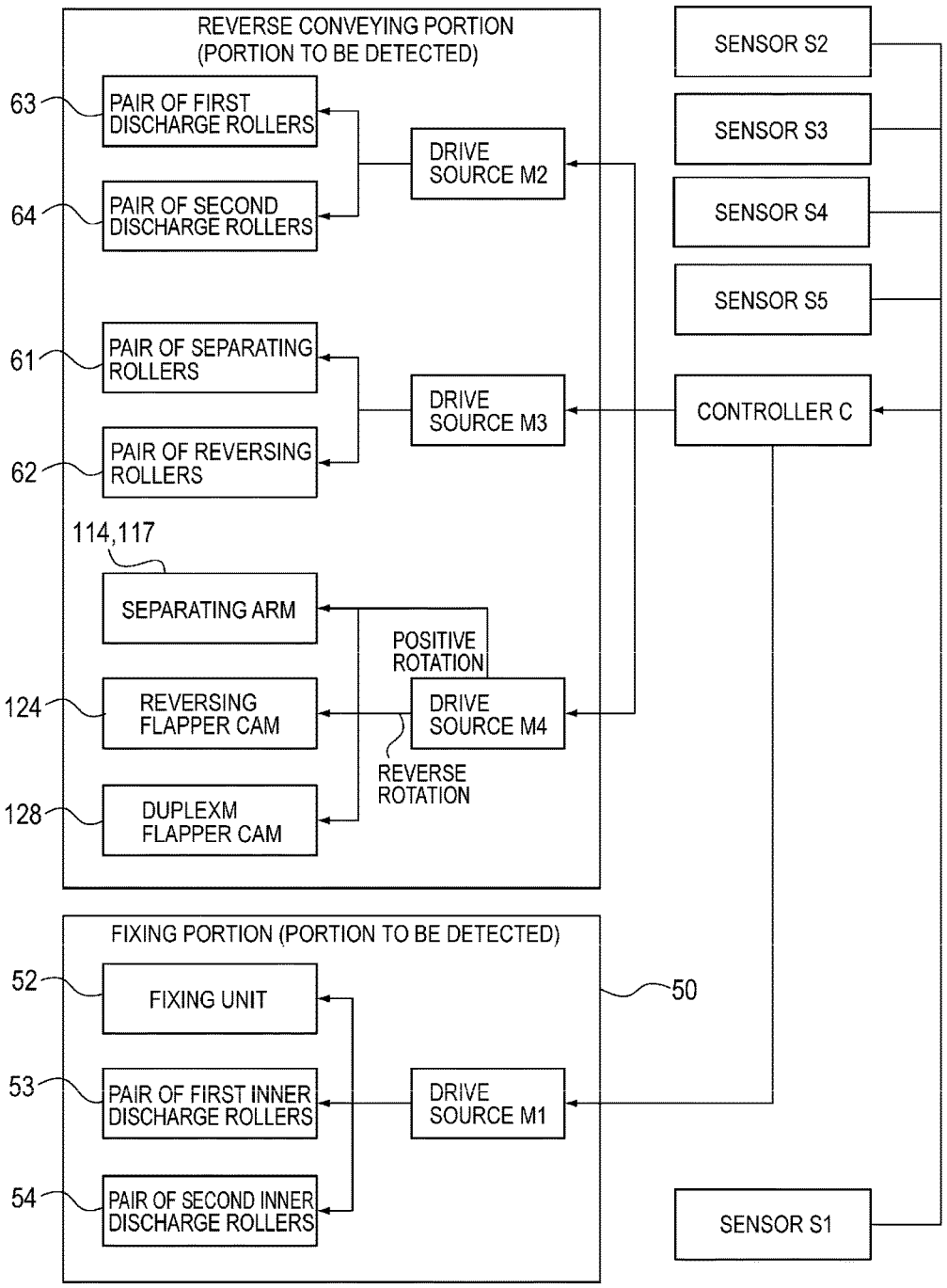
FIG. 5 is a block diagram illustrating a drive system of a fixing portion and a reverse conveying portion.

FIG. 5 is a block diagram of a drive system of the fixing portion 50 and the reverse conveying portion 60. As illustrated in FIG. 5, the fixing unit 52, the pair of first inner discharge rollers 53, and the pair of second inner discharge rollers (the pair of conveying rollers) 54 in the fixing portion 50 are connected to a drive source M1. The pair of separating rollers 61 and the pair of reversing rollers 62 in the reverse conveying portion 60 are connected to a drive source M3. The pair of first discharge rollers 63 and the pair of second discharge rollers 64 in the reverse conveying portion 60 are connected to a drive source M2. A separating arm 114, a reversing flapper cam 124, and a duplex flapper cam 128 in the reverse conveying portion 60 are connected to a drive source M4. The controller C controls operations of the drive sources M1 to M4 on the basis of the detection signals from the sensors S1 to S5.

Figure 6:
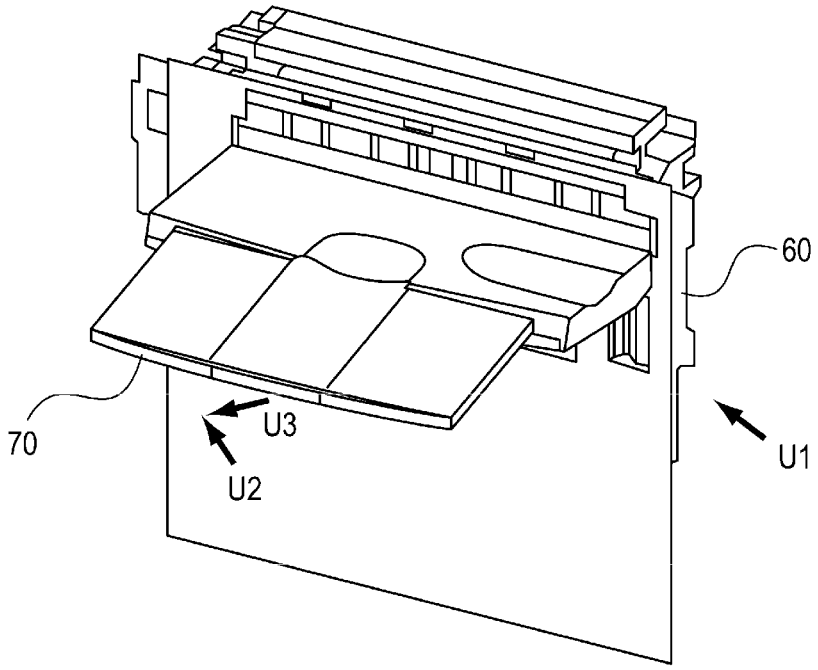
FIG. 6 is a perspective view of the reversing portion.
Figure 7A:
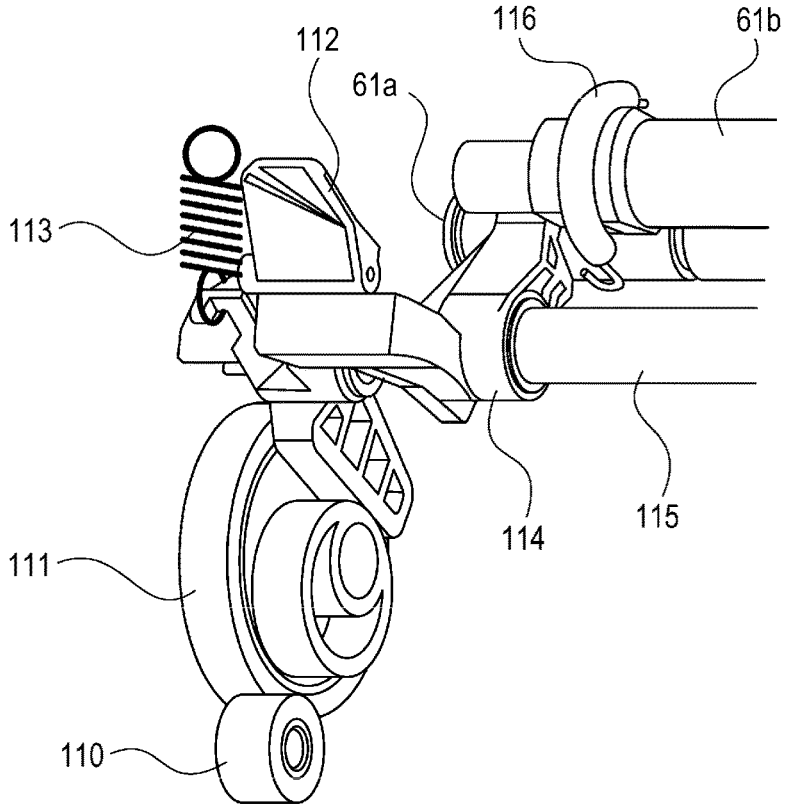
FIGS. 7A and 7B are perspective views of a separating portion of a separating roller.
Figure 7B:
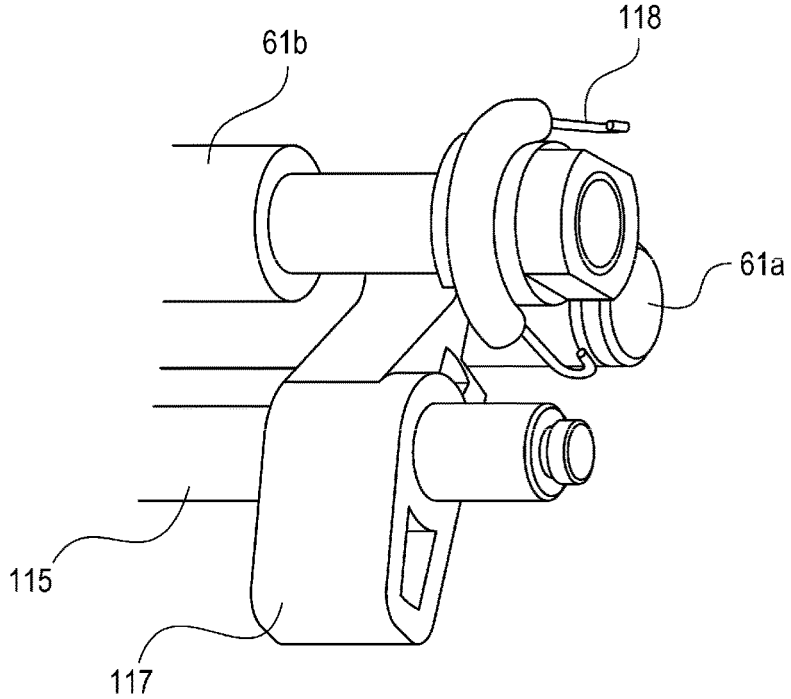

The separating portion in the above-mentioned reverse conveying portion 60 will be described below. FIG. 6 is a perspective view of the reverse conveying portion 60 and the discharge tray 70. FIGS. 7A and 7B are perspective views of the separating portion when viewed from the direction of arrow U1 in FIG. 6. FIG. 7A illustrates the pair of separating rollers 61 disposed in the back of the reverse conveying portion 60 and the separating portion thereof. A drive gear 110 is rotationally driven (positively rotates) by the drive source M4 illustrated in FIG. 5, and the drive gear 110 causes a cam-integrated gear 111 to rotate. Subsequently, with the rotation of the cam-integrated gear 111, a reverse separating link 112 rotates against an elastic force of a link biasing spring 113. One end of the reverse separating link 112 presses one end of the separating arm 114 which is disposed at one end of a reverse separating link shaft 115, and the separating arm 114 rotates along with the reverse separating link shaft 115. One end of the separating arm 114 moves a separating follower roller 61*b* against the biasing of a separating spring 116 to release the nip of the pair of separating rollers 61 by pressing the separating follower roller 61*b* among the separating driving roller 61*a* and the separating follower roller 61*b* of the pair of separating rollers 61. Here, the separating arm 114 is an example of the separating portion. FIG. 7B illustrates the separating portion disposed in front of the reverse conveying portion 60. The other end of the reverse separating link shaft 115 is provided with a separating arm 117, and the separating arm 117 rotates along with the separating arm 114. Similarly to the separating arm 114, one end of the separating arm 117 moves the separating follower roller 61*b* against the biasing of the separating spring 118, thereby suppressing the inclination of the pair of separating rollers 61 and releasing the nip at the time of separation. A conveyer that conveys a sheet in the drawer portion 100 or the reverse conveying portion 60 (in the conveying portion) includes the pair of first inner discharge rollers 53, the pair of second inner discharge rollers 54, and the pair of separating rollers 61.

Subsequently, a process when a jam occurs in a state in which a sheet spans the reverse conveying portion 60 and the drawer portion 100 at the time of image formation on plural sheets in this embodiment will be described. When a jam occurs in a state in which a sheet spans the reverse conveying portion 60 and the drawer portion 100 and the drawer portion 100 is drawn, the sheet is torn and a part of the sheet may remain in the image forming apparatus 1 and serves as an obstacle of a next image forming operation. When a source of the jam is present upstream in the conveying direction from the sheet spanning the reverse conveying portion 60 and the drawer portion 100, the state in which the sheet spans the reverse conveying portion 60 and the drawer portion 100 is avoided by conveying the sheet spanning the reverse conveying portion 60 and the drawer portion 100 and a sheet downstream in the conveying direction thereof to the downstream side in the conveying direction.

Figure 8:
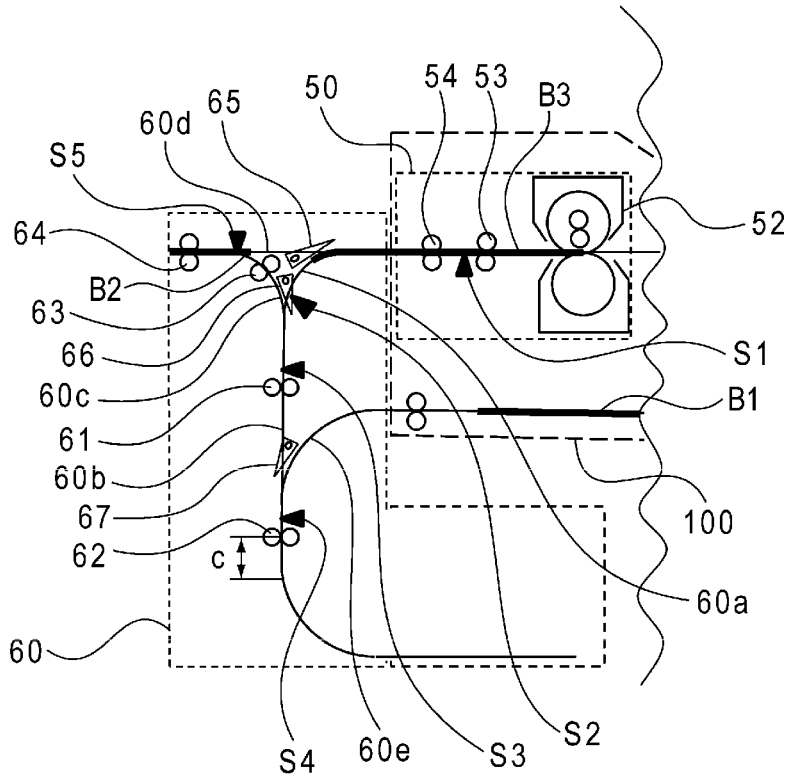
FIG. 8 is a schematic diagram illustrating a conveying operation in the embodiment.

When a jam occurs at the time of duplex image formation on plural sheets, an example of sheet positions in the reverse conveying portion 60 is illustrated in FIG. 8. As illustrated in FIG. 8, a sheet B1 is subjected to a first-surface image forming process and is supplied to a second-surface image forming process through the reverse guide path 60*a*, the switchback path 60*b*, and the duplex conveying portion 80. A sheet B2 is subjected to the second-surface image forming process and is discharged via the straight path 60*d*. A sheet B3 is subjected to the first-surface image forming process and is supplied to the second-surface image forming process through the reverse guide path 60*a*, the switchback path 60*b*, and the duplex conveying portion 80. As described above, the sheet B1 subjected to the first-surface image forming process is sent to the duplex conveying portion 80 through the reverse guide path 60*a* and the switchback path 60*b*, and the sheet B2 subjected to the second-surface image forming process is discharged through the straight path 60*d*. Since the first-surface image forming process and the second-surface image forming process are alternately performed and the path in the reverse conveying portion 60 varies for the first surface and the second surface, a space for conveying the sheet B3 spanning the reverse conveying portion 60 and the drawer portion 100 is empty by one sheet. When a jam occurs at the time of duplex image formation, the sheet spanning the reverse conveying portion 60 and the drawer portion 100 is conveyed to the empty space corresponding to one sheet, thereby causing the sheet to retract.

Figure 9:
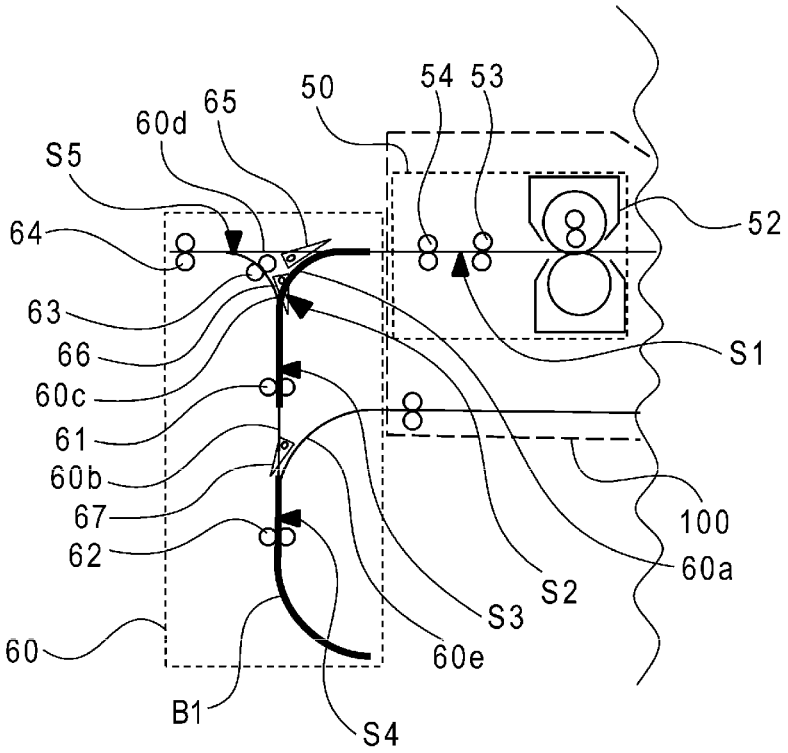
FIG. 9 is a schematic diagram illustrating a conveying operation in the embodiment.

An example in which the length in the conveying direction of two sheets is smaller than the total length of the reverse guide path 60*a* and the switchback path 60*b* is illustrated in FIG. 9. As illustrated in FIG. 9, the preceding sheet B1 is sent to the switchback path 60*b*, then the subsequent sheet B2 is sent to the switchback path 60*b*, and then the two sheets B1 and B2 are disposed in the reverse conveying portion 60. Accordingly, the state in which a sheet spans the reverse conveying portion 60 and the drawer portion 100 is avoided.

However, when a jam occurs in a sheet downstream in the conveying direction from the sheet B2 spanning the reverse conveying portion 60 and the drawer portion 100 at the time of one-sided image formation on plural sheets, the preceding sheet B1 is present and thus there is no space for causing the sheet B2 to retract. When the jammed sheet is conveyed, there is a possibility that a scratch or a crease formed at the time of occurrence of the jam will be hooked to a conveying guide or a conveying roller to damage the sheet. Accordingly, it is difficult to send a jammed sheet downstream in the conveying direction along with the sheet B2. When the length in the conveying direction of two sheets is larger than the total length of the reverse guide path 60*a* and the switchback path 60*b*, there is no space for receiving the two sheets and thus the two sheets cannot be received in the reverse conveying portion 60. Accordingly, by performing a jam recovery process illustrated in the flowchart of FIGS. 10A and 10B, the sheet spanning the reverse conveying portion 60 and the drawer portion 100 retracts.

Figure 10A:
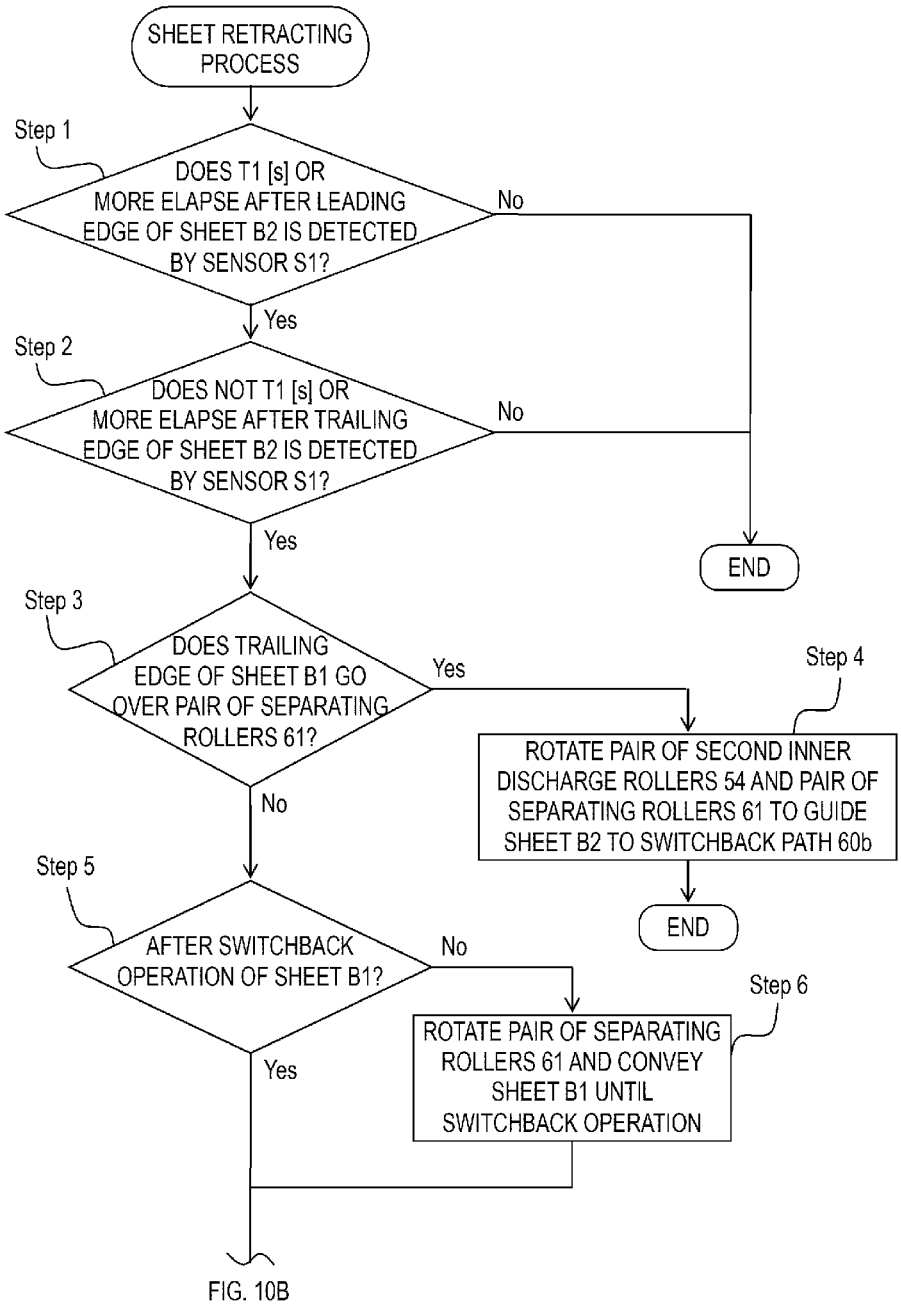
FIGS. 10A and 10B are a flowchart illustrating a flow of a conveying operation when a sheet size is small.
Figure 10B:
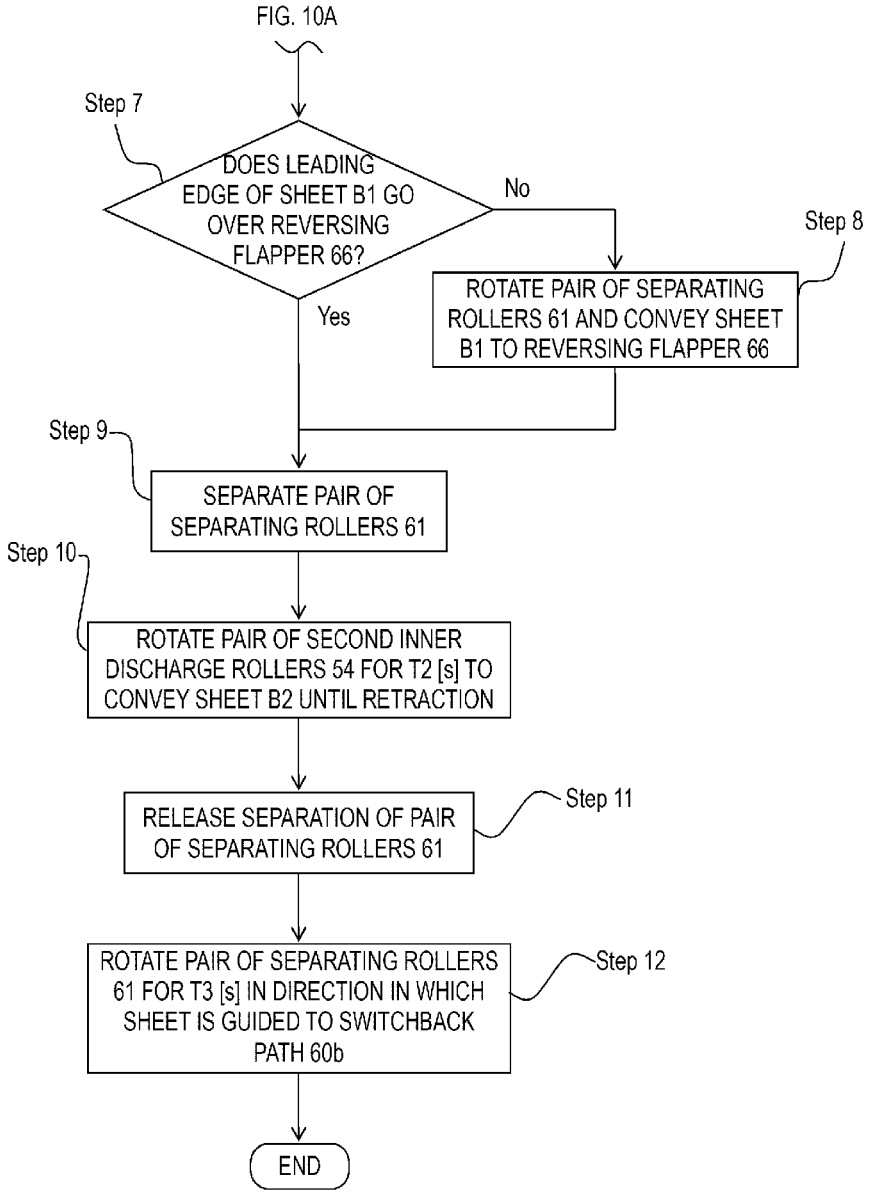

Control when a jam occurs downstream in the conveying direction from the sheet B2 in a state in which the sheet B2 of A4 spans the drawer portion 100 and the reverse conveying portion 60 as illustrated in FIG. 3A will be described below as an example of the jam recovery control process in the reverse conveying portion 60. When a jam occurs, it is first determined whether a sheet spans the drawer portion 100 and the reverse conveying portion 60 (Step 1 and Step 2) as illustrated in the flowchart of FIG. 10A. When a time T1 [s] required for moving from the drawer portion 100 to the reverse conveying portion 60 elapses after the leading edge of the sheet B2 is detected by the sensor S1 and the time T1 [s] does not elapse after the trailing edge of the sheet is detected by the sensor S1, this means the state in which the sheet B2 spans the drawer portion 100 and the reverse conveying portion 60.

Subsequently, by detecting whether the trailing edge of the preceding sheet B1 passes through the sensor S3, it is determined whether the sheet B1 preceding the subsequent sheet B2 spanning the drawer portion 100 and the reverse conveying portion 60 is conveyed above the pair of separating rollers 61 after being conveyed in the switchback manner and whether the sheet B1 is nipped by the pair of separating rollers 61 (Step 3). When the trailing edge of the sheet B1 is located at a position over the pair of separating rollers 61, the subsequent sheet B2 is made to retract from the drawer portion 100 by causing the pair of second inner discharge rollers 54 and the pair of separating rollers 61 to rotate to guide the subsequent sheet B2 to the switchback path 60*b* (Step 4).

Figure 11:
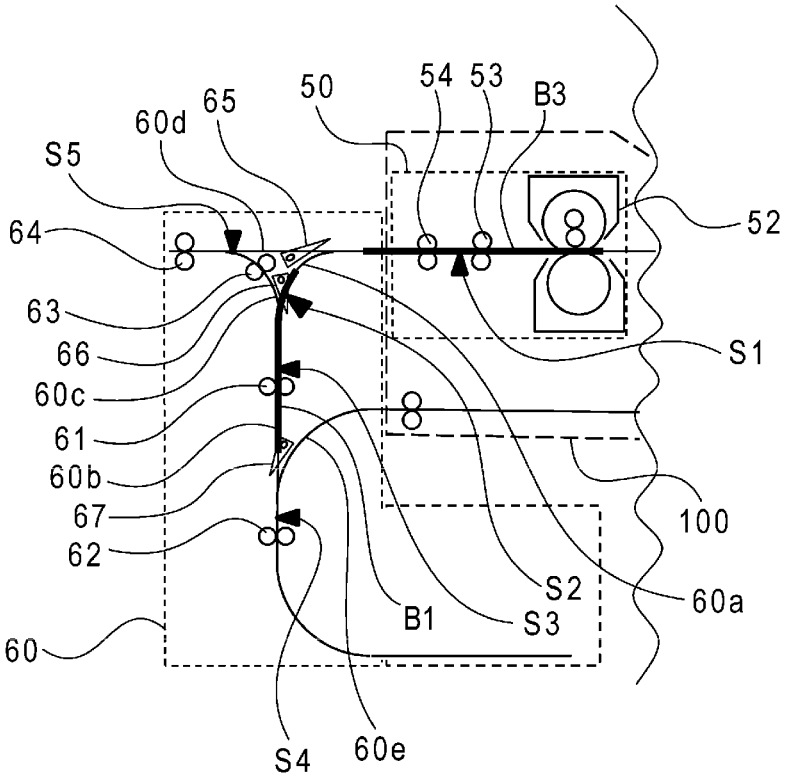
FIG. 11 is a schematic diagram illustrating a conveying operation in the embodiment.

When the preceding sheet B1 is in a state before the switchback operation as illustrated in FIG. 11 or when the leading edge of the preceding sheet B1 does not move over the reversing flapper 66 even after the switchback operation, the edges of the subsequent sheet B2 and the preceding sheet B1 come in contact with each other by conveying the subsequent sheet B2. Accordingly, the position of the preceding sheet B1 is determined (Step 5). It is determined whether the preceding sheet B1 is in a state after the switchback operation, and the conveyance of the preceding sheet B1 continues when the preceding sheet B1 is in the state before the switchback operation (Step 6). In order to avoid contact of the edges of the preceding sheet B1 and the subsequent sheet B2 with each other, it is determined whether the leading edge of the preceding sheet B1 is located at a position over the reversing flapper 66 (Step 7). When the leading edge of the preceding sheet B1 is not located at a position over the reversing flapper 66, the conveyance continues to the position (Step 8).

The state in which the leading edge of the preceding sheet B1 is over the reversing flapper 66 after the switchback operation is as follows. The preceding sheet B1 conveyed from the reverse guide path 60*a* to the switchback path 60*b* is conveyed by the pair of separating rollers 61 which positively rotate until the trailing edge thereof passes through the reversing flapper 66. When it is detected from the detection signal of the sensor S2 that the trailing edge of the preceding sheet B1 passes through the reversing flapper 66, the pair of separating rollers 61 rotates reversely and the preceding sheet B1 is guided to the reverse discharge path 60*c* by the reversing flapper 66. At this time, the leading edge of the preceding sheet B1 (the trailing edge at the time of conveyance by positive rotation) passes through the reversing flapper 66. This is a state in which the leading edge of the preceding sheet B1 is over the reversing flapper 66 after the switchback operation.

Figure 3B:
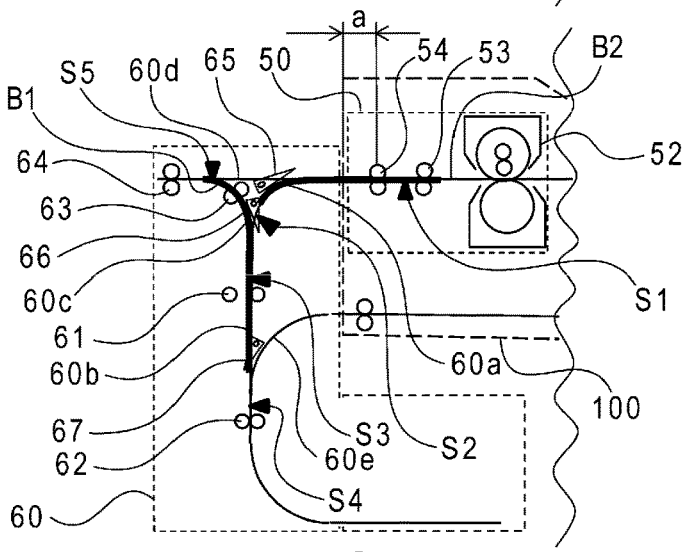
Figure 3C:
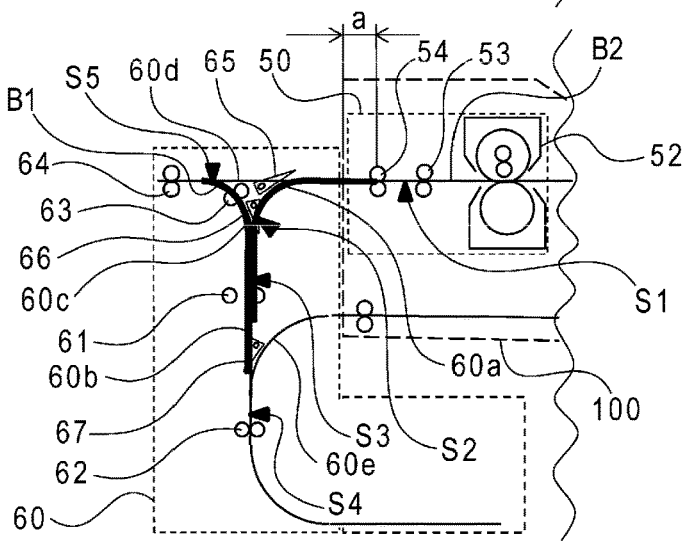

Subsequently, the pair of separating rollers 61 are separated from each other as illustrated in FIG. 3B (Step 9). As illustrated in FIG. 3C, the subsequent sheet B2 spanning the reverse conveying portion 60 and the drawer portion 100 is conveyed between the pair of separating rollers 61 by rotation of the pair of second inner discharge rollers 54 (Step 10). By separating the pair of separating rollers 61, a space to which the subsequent sheet B2 is sent can be formed and the subsequent sheet B2 can be conveyed without additionally moving the preceding sheet B1 located in the reverse discharge path 60*c*.

Figure 4A:
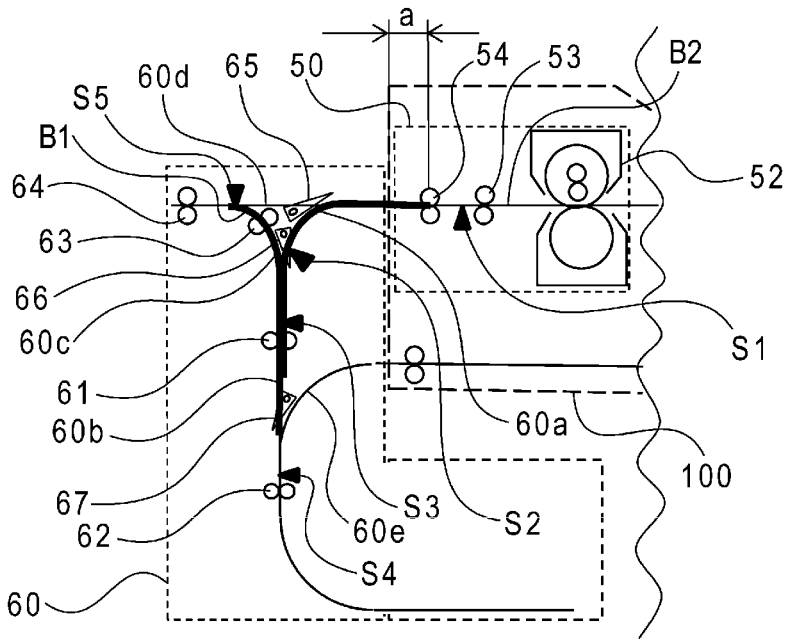
FIGS. 4A and 4B are schematic diagrams illustrating a conveying operation in the embodiment.
Figure 4B:
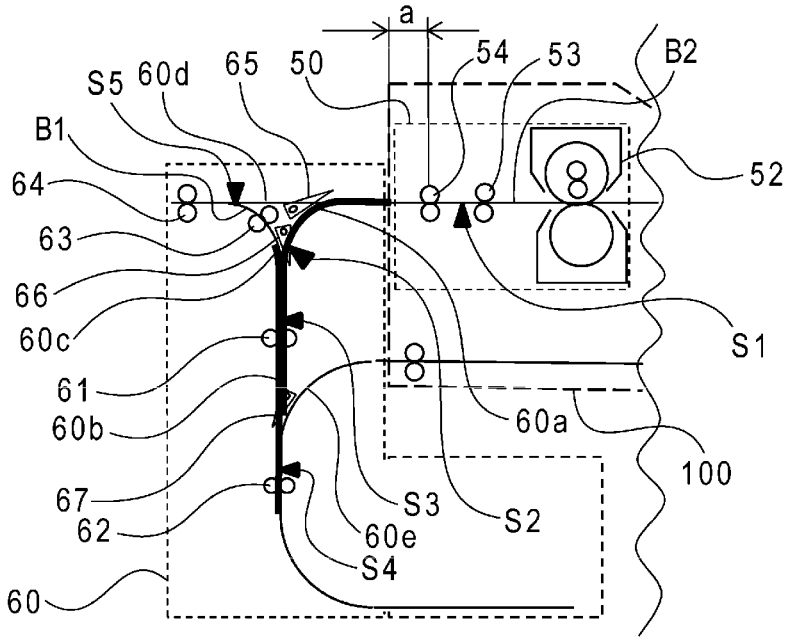

In this embodiment, no conveying roller is present between the pair of second inner discharge rollers 54 of the fixing portion 50 and the pair of separating rollers 61 of the reverse conveying portion 60. Accordingly, when the length of the subsequent sheet B2 is smaller than the length from the pair of second inner discharge rollers 54 and the pair of reversing rollers 62 and the subsequent sheet B2 passes through the pair of second inner discharge rollers 54, the conveying force disappears. Therefore, first, the subsequent sheet B2 is conveyed by detecting the trailing edge of the subsequent sheet B2 using the sensor S1 and rotating the pair of second inner discharge rollers 54 for a time T2 [s] required until the subsequent sheet B2 passes through the pair of second inner discharge rollers 54. Thereafter, as illustrated in FIG. 4A, the separation of the pair of separating rollers 61 is released to nip both the preceding sheet B1 and the subsequent sheet B2 (Step 11). Finally, as illustrated in FIG. 4B, in order to allow the subsequent sheet B2 to pass through the drawer portion 100, the pair of separating rollers 61 and another pair of rollers nipping the preceding sheet B1 are made to rotate for a time T3 [s] required for conveyance by the length a between the pair of second inner discharge rollers 54 and the end of the drawer portion 100 to convey simultaneously the preceding sheet B1 and the subsequent sheet B2 below the switchback path 60*b* (Step 12).

By performing the above-mentioned process, it is possible to minimize a degree of conveyance of the preceding sheet B1, to prevent the preceding sheet B1 from being damaged even when a jam occurs due to the preceding sheet B1, and to process the subsequent sheet B2 spanning the drawer portion 100 and the reverse conveying portion 60. That is, according to this embodiment, when a jam occurs in a sheet, it is possible to suppress conveyance of a preceding sheet, to prevent a crease or damage of a sheet, and to prevent damage of a subsequent sheet due to drawing of the drawer portion.

As described above, since the reversing flapper biasing spring 125 and the duplex flapper biasing spring 129 apply a force to any of the reversing flapper 66 and the duplex flapper 67 at the time of image formation and the sheet B is conveyed against the biasing force with the conveying force of the sheet B, conveyance resistance is great. However, in the jam recovery process according to this embodiment, when the preceding sheet B1 is a source of the jam, the conveyance resistance of the subsequent sheet B2 increases at the time of frictional rubbing of the sheets due to a crease or a scratch formed at the time of occurrence of the jam of the preceding sheet B1 and there is a possibility that the conveying torque will be insufficient and the above-mentioned control process will not be performed. Accordingly, by switching the reversing flapper 66 and the duplex flapper 67 at the time of the jam recovery, the conveyance resistance is reduced. Since the preceding sheet B1 is pressed on the guide by switching the reversing flapper 66 against the biasing force, it is possible to reduce the conveyance resistance of the subsequent sheet B2 due to the reversing flapper 66 and the resistance due to the sheet B1. By switching the duplex flapper 67 against the biasing force, it is possible to reduce the resistance due to the preceding sheet B1 or the duplex flapper 67

Figure 12A:
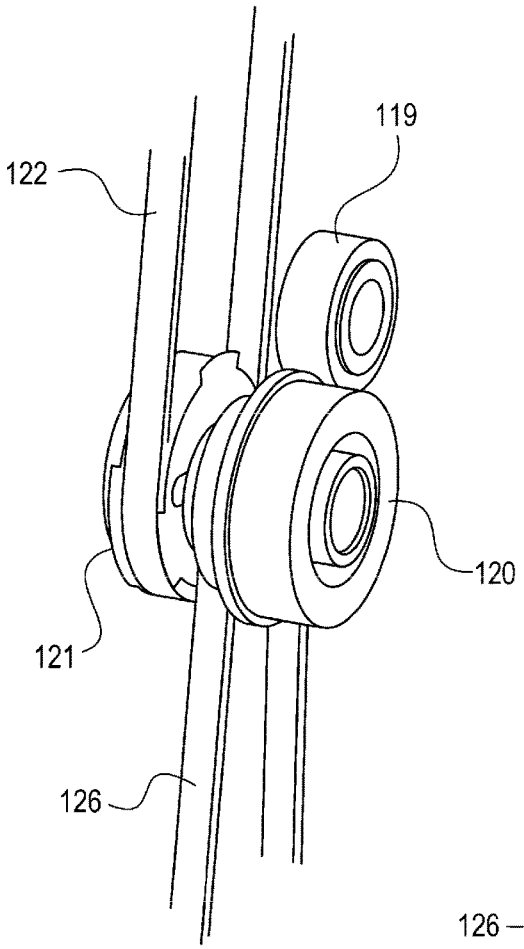
FIGS. 12A, 12B, and 12C are perspective views of a switching portion of a reversing flapper and a duplex flapper.
Figure 12B:
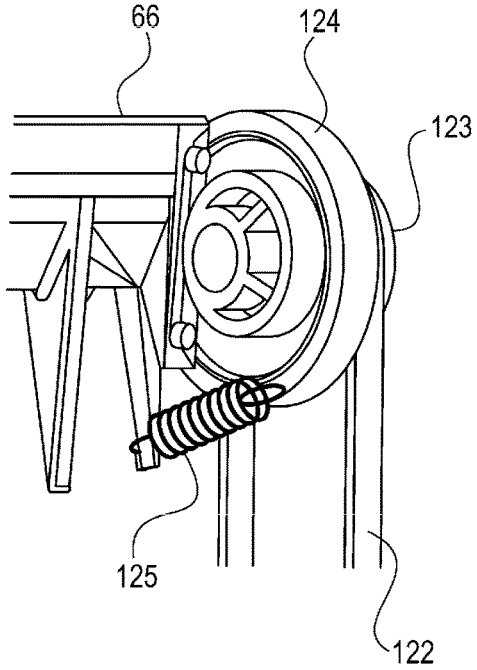
Figure 12C:
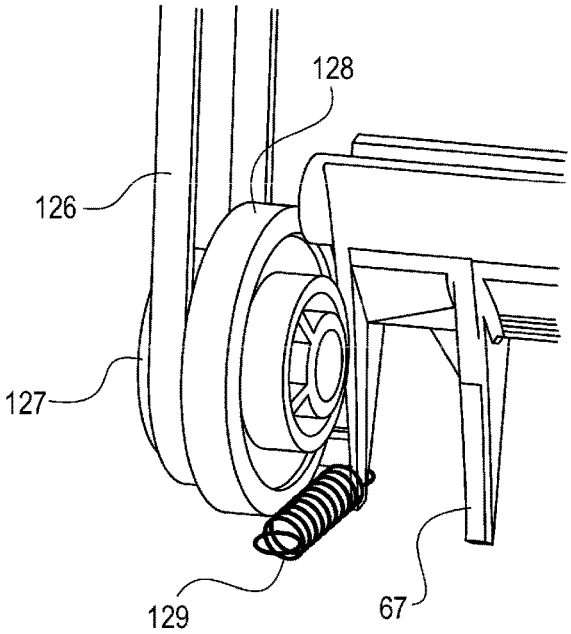

Switching portions of the flappers which are disposed in the back of the reverse conveying portion 60 will be described below with reference to FIGS. 12A to 12C. FIG. 12A illustrates a drive transmitting portion around the drive gear 110 when viewed from the direction of arrow U2 in FIG. 6. FIG. 12B illustrates the switching portion of the reversing flapper 66 when viewed from the direction of arrow U3 in FIG. 6. FIG. 12C illustrates the switching portion of the duplex flapper 67 when viewed from the direction of arrow U2 in FIG. 6.

A flapper driving gear 119 rotationally driven (reversely rotates) with a driving force from the drive source M4 illustrated in FIG. 5, and a pulley gear 120 transmits the driving force to a first reversing flapper pulley 121. Accordingly, a reversing flapper belt 122 receives a driving force from the first reversing flapper pulley 121 and transmits the driving force to a second reversing flapper pulley 123 illustrated in FIG. 12B to simultaneously rotate a reversing flapper cam 124. The reversing flapper 66 is switched to form a path in the reverse guide path 60*a* by pressing the reversing flapper 66 to which the reversing flapper biasing spring 125 applies a force to rotate the reversing flapper 66 using the reversing flapper cam 124.

Similarly, the pulley gear 120 also serves as a pulley and transmits the rotational driving force to a duplex flapper pulley 127 illustrated in FIG. 12C via a duplex flapper belt 126. The rotation of the duplex flapper pulley 127 is transmitted to a duplex flapper cam 128, and the duplex flapper 67 is switched to form a path in the switchback path 60*b* by pressing the duplex flapper 67 to which the duplex flapper biasing spring 129 applies a force using the duplex flapper cam 128.

As described above, by switching two flappers in synchronization with the jam recovery control process, it is possible to suppress the conveyance resistance of a sheet at the time of occurrence of a jam and to satisfactorily perform the above-mentioned jam recovery control process.

The reversing flapper 66 is switched to form a path in the reverse discharge path 60*c* by the biasing force of the reversing flapper biasing spring 125 by releasing the pressing by the reversing flapper cam 124. Similarly, the duplex flapper 67 is switched to form a path in the duplex conveying path 60*e* by the biasing force of the duplex flapper biasing spring 129 by releasing the pressing by the duplex flapper cam 128.

Figure 13:
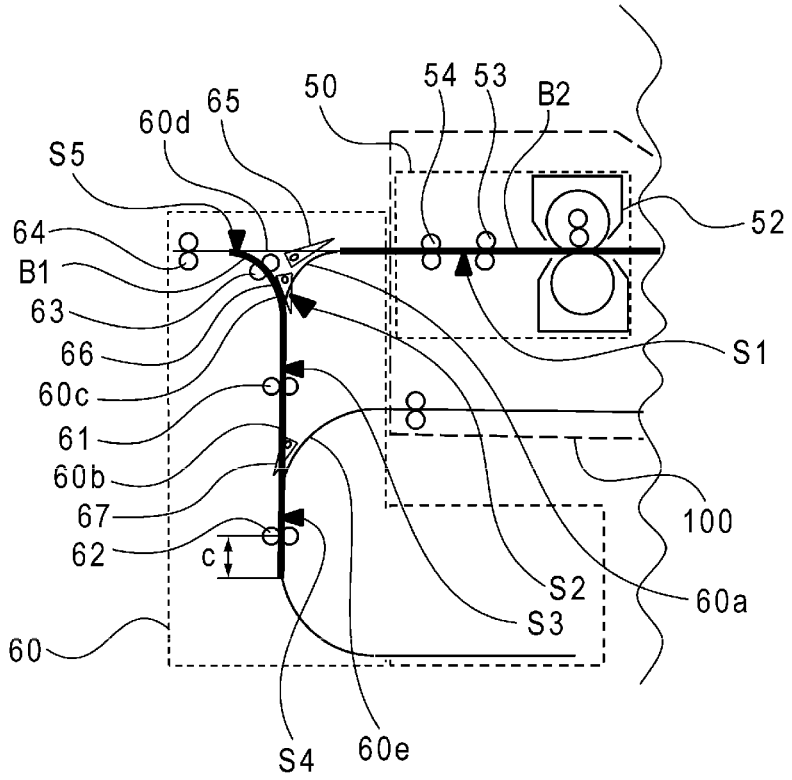
FIG. 13 is a schematic diagram illustrating a conveying operation in the embodiment.

Subsequently, a jam recovery control process when a jam occurs in a state in which a sheet spanning the drawer portion 100 and the reverse conveying portion 60 is present with a large sheet size will be described. As illustrated in FIG. 13, when the sheet size of the preceding sheet B1 is large and a jam occurs in the state in which the preceding sheet B1 is nipped by the pair of reversing rollers 62 as well as the pair of separating rollers 61, the following operation is carried out. In the flowchart illustrated in FIGS. 10A and 10B, first, the pair of separating rollers 61 are separated, and the subsequent sheet B2 is sent to the switchback path 60*b* and is conveyed to the pair of reversing rollers 62 through between the pair of separating rollers 61 separated from each other. Then, the separation of the pair of separating rollers 61 is released and the sheets B1 and B2 are simultaneously conveyed below the switchback path 60*b* until the trailing edge of the subsequent sheet B2 retracts from the drawer portion 100. At this time, since the sheet B1 is not a source of the jam, there is no problem in conveyance.

Figure 14:
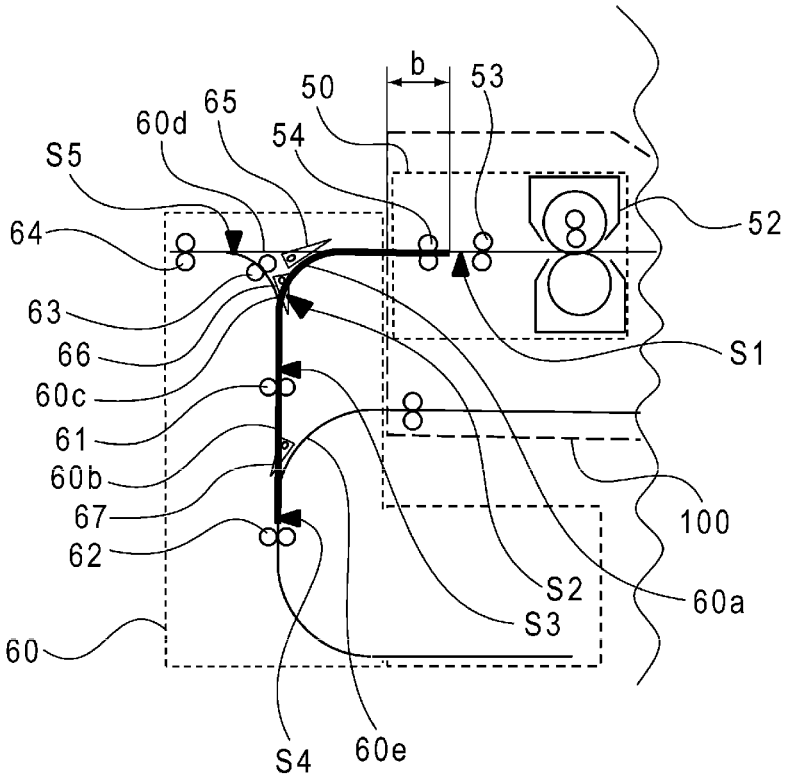
FIG. 14 is a schematic diagram illustrating a conveying operation in the embodiment.

Here, as illustrated in FIG. 14, in order to cause the subsequent sheet B2 to retract from the drawer portion 100 after the separation of the pair of separating rollers 61 is released, it is necessary to convey the sheet by a length b. Accordingly, when the leading edge of the preceding sheet B1 protrudes by a length c from the pair of reversing rollers 62 as illustrated in FIG. 13, the preceding sheet B1 is conveyed below the switchback path 60*b* from the pair of reversing rollers 62 by the total length of the length b and the length c in order to convey the subsequent sheet B2 by the length b which is required for retraction from the drawer portion 100. Accordingly, the length from the pair of reversing rollers 62 of the switchback path 60*b* to the end of the switchback path 60*b* has to be larger than the length b+c.

Figure 15A:
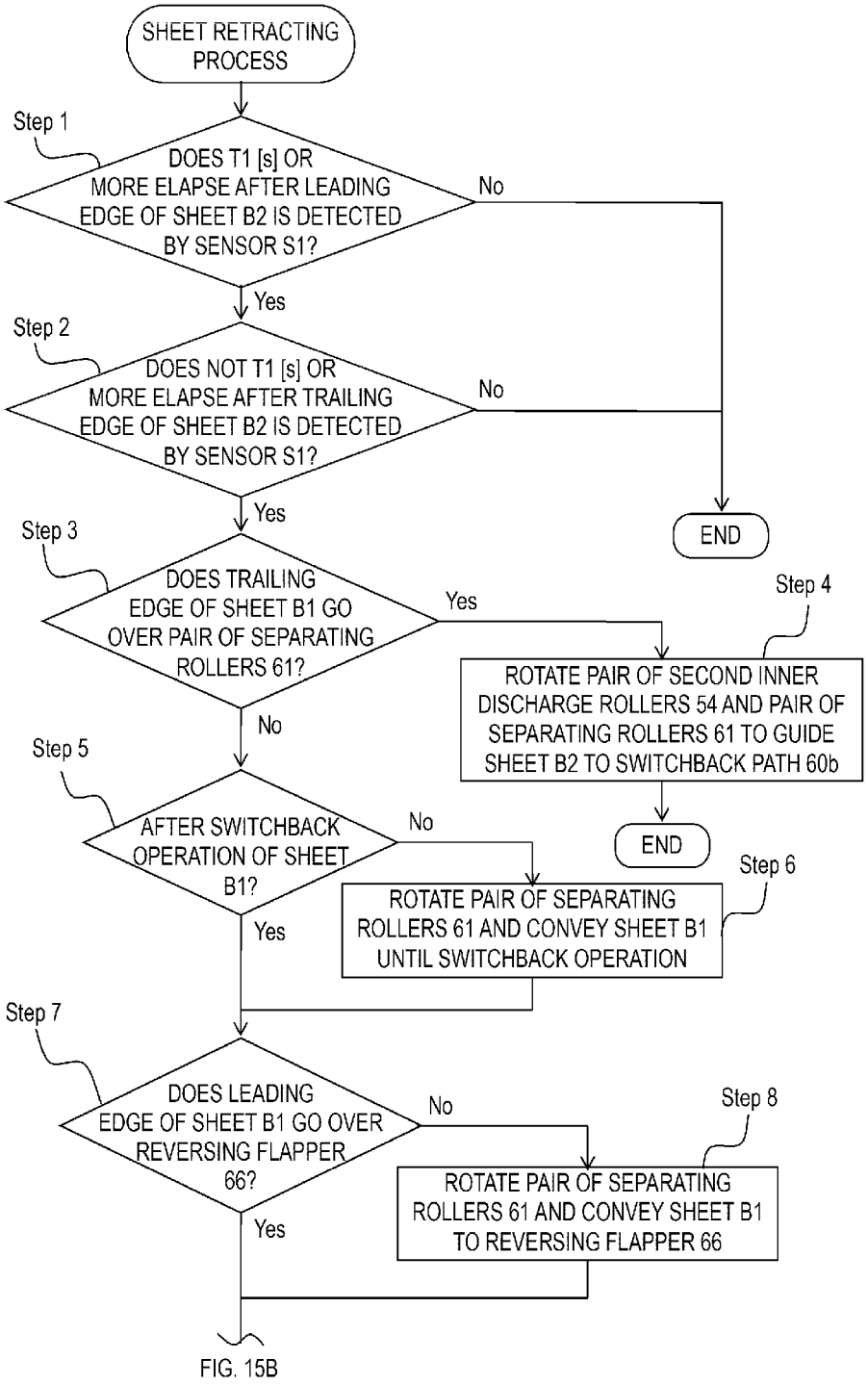
FIGS. 15A and 15B are a flowchart illustrating a flow of a conveying operation when a sheet size is large.
Figure 15B:
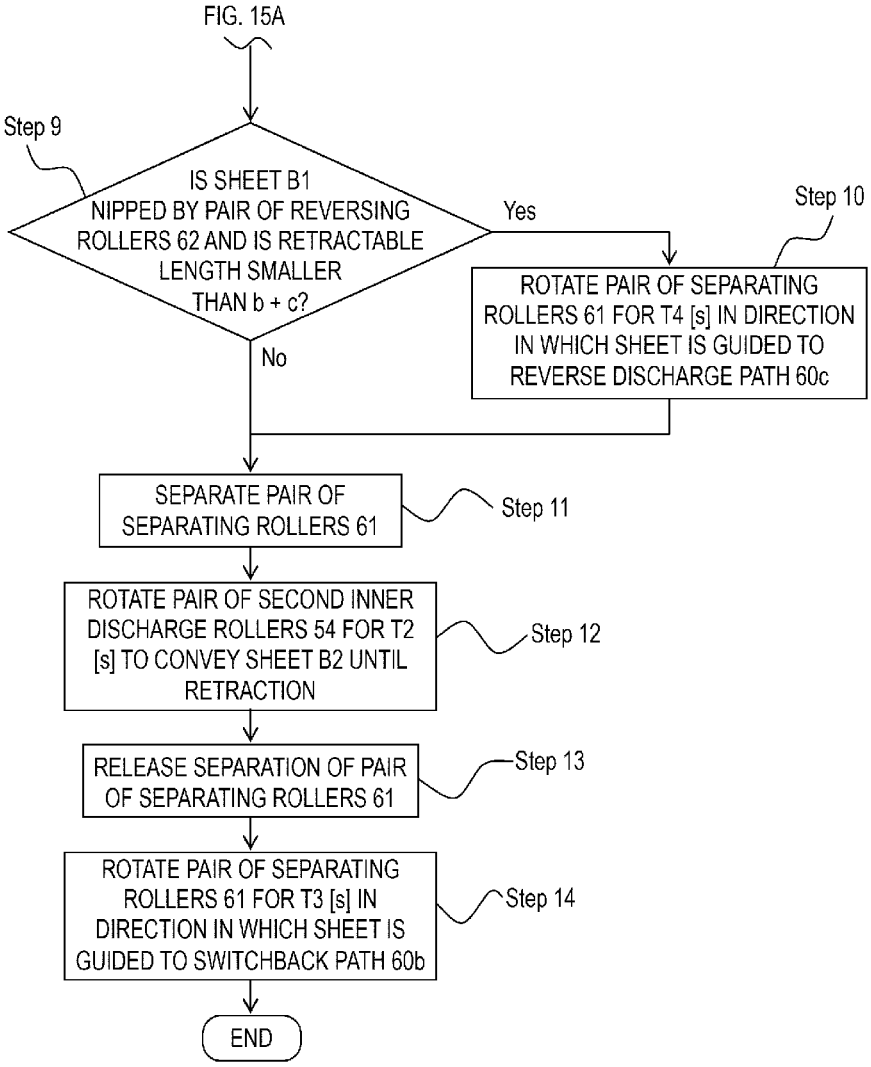

Therefore, when a sheet having a size with a possibility of guidance by equal to or greater than the length of the switchback path 60*b* retracts from the drawer portion 100, the jam recovery control process of the flowchart illustrated in FIGS. 15A and 15B is performed. The processes up to Step 8 are the same as in the flowchart illustrated in FIGS. 10A and 10B, but the leading edge of the preceding sheet B1 is detected in Step 9 and the preceding sheet B1 is conveyed upward for a time T4 [s] up to a position at which the length b+c is shorter than a retractable length when the total length of the retraction length b required for the subsequent sheet B2 and the length c from the leading edge of the preceding sheet B1 to the pair of reversing rollers 62 is larger than the retractable length (Step 10). As a result, it is possible to prevent a sheet from being hooked downward due to an insufficient length of the switchback path 60*b* and to prevent the conveying driving force from being insufficient due to a crease formed in the sheet. The steps subsequent to Step 11 are the same as the steps subsequent to Step 9 in the flowchart illustrated in FIG. 10B.

Figure 16:
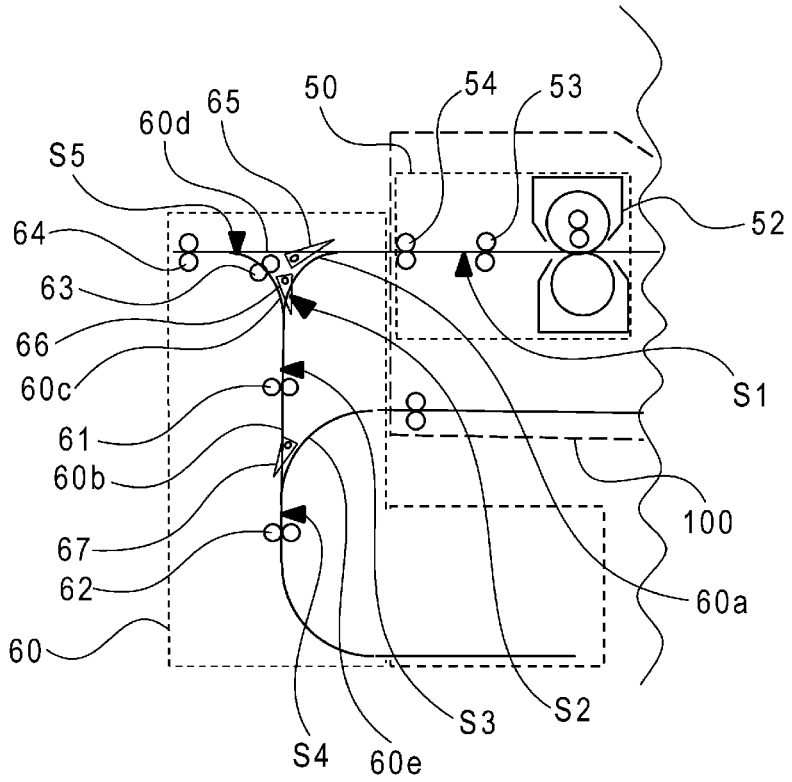
FIG. 16 is a schematic diagram of the reversing portion.

In the above-mentioned embodiment, the configuration in which the subsequent sheet B2 spanning the drawer portion 100 and the reverse conveying portion 60 is conveyed between the pair of separating rollers 61 by the pair of second inner discharge rollers 54 of the drawer portion 100 and then is conveyed along with the preceding sheet B1 by the pair of separating rollers 61 is exemplified. However, the present invention is not limited to this configuration. By using the pair of conveying rollers of the drawer portion 100 as a pair of discharge rollers for discharging a sheet from the drawer portion 100, it is possible to convey the spanned subsequent sheet B2 up to a non-spanning position. As illustrated in FIG. 16, a configuration in which the pair of second inner discharge rollers 54 as a pair of conveying rollers are disposed in a most downstream part in the sheet conveying direction of the drawer portion 100 may be employed. By employing this configuration, it is possible to satisfactorily convey the spanned sheet up to a non-spanning position even without using a conveying operation by the pair of separating rollers 61 of the reverse conveying portion 60, thereby obtaining the same effects as in the above-mentioned embodiment.

In the above-mentioned embodiment, the reverse conveying portion is exemplified as the conveying portion that conveys a sheet received from the drawer portion, but the present invention is not limited to this configuration. So long as a relationship of the drawer portion that is drawable from the apparatus body and the conveying portion that conveys a sheet received from the drawer portion is satisfied, the present invention can be applied to another sheet conveying apparatus or an image forming apparatus having the sheet conveying apparatus to obtain the same effects.

In the above-mentioned embodiment, a printer is exemplified as the image forming apparatus, but the present invention is not limited to this example. For example, another image forming apparatus such as a copying machine or a facsimile machine or another image forming apparatus such as a multifunction machine in which such functions are combined may be used as the image forming apparatus. The present invention is not limited to an image forming apparatus in which an intermediate transfer member is used, color toner images are sequentially transferred to the intermediate transfer member in a superimposed manner, and the toner images carried on the intermediate transfer member are transferred to a transfer medium in a batch manner. For example, an image forming apparatus in which a transfer medium holder is used and color toner images are sequentially transferred to a transfer medium held by the transfer medium holder in a superimposed manner may be used. The same effects can be obtained by applying the present invention to a sheet conveying apparatus of such an image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2015-180361, filed Sep. 14, 2015, which is hereby incorporated by reference herein in its entirety.

What is claimed is:

1. An image forming apparatus comprising:

a transforming portion that is configured to transfer a toner image to a sheet;

a fixing portion that is configured to fix the toner image on the sheet;

a drawer portion that (a) is drawable from an apparatus body and (b) includes a first pair of conveying rollers which is disposed at a downstream side of the fixing portion in a sheet conveying direction and which conveys the sheet on which the toner image was fixed by the fixing portion;

a conveying portion that (a) is disposed in the apparatus body and (b) includes a pair of separating rollers which conveys the sheet received from the first pair of conveying rollers and which come in contact with and are separated from each other, the pair of separating rollers conveying the sheet by reverse rotation after conveying the sheet received from the first pair of conveying rollers by positive rotation;

a second pair of conveying rollers that receives the sheet conveyed by the reverse rotation of the pair of separating rollers and conveys the sheet; and a controller that controls operations of the drawer portion and the conveying portion such that: the pair of separating rollers are separated from each other when a jam of a sheet occurs in a state in which (i) a preceding sheet is nipped by the pair of separating rollers and (ii) a subsequent sheet subsequent to the preceding sheet spans the drawer portion and the conveying portion, the first pair of conveying rollers conveys the subsequent sheet to a part between the pair of separating rollers, the separation of the pair of separating rollers is released, and the pair of separating rollers conveys the subsequent sheet along with the preceding sheet to a position at which the subsequent sheet does not span the drawer portion and the conveying portion.

2. The sheet conveying apparatus according to claim 1, wherein the conveying portion comprises a reverse conveying portion including a reverse switching member that switches a conveying path of the sheet received from the drawer portion, conveying the received sheet in a switchback manner via the reverse switching member by positively or reversely rotating the pair of separating rollers, and inverting front and rear sides of the sheet.

3. The sheet conveying apparatus according to claim 2, wherein the controller controls such that the pair of separating rollers conveys a leading edge of the preceding sheet to the reverse switching member in a case that the preceding sheet is not conveyed to the reverse switching member after the preceding sheet is conveyed in the switchback manner at the time of occurrence of the jam.

4. The sheet conveying apparatus according to claim 2, wherein the reverse conveying portion includes:

a reverse biasing member that applies a force to the reverse switching member so as to form a second conveying path different from a first conveying path which guides the sheet received from the drawer portion to the pair of separating rollers; and a reverse switching portion that switches the reverse switching member against a biasing force of the reverse biasing member so as to form the first conveying path when the jam occurs.

5. The sheet conveying apparatus according to claim 4, wherein the reverse conveying portion further includes:

a duplex switching member that is disposed downstream in a sheet conveying direction from the pair of separating rollers and that switches the conveying path of the sheet received from the pair of separating rollers;

a pair of reversing rollers that conveys the received sheet in a switchback manner via the duplex switching member by positive rotation or reverse rotation;

a duplex biasing member that applies a force to the duplex switching member so as to form a fourth conveying path different from a third conveying path which guides the sheet received from the pair of separating rollers to the pair of reversing rollers; and a duplex switching portion that switches the duplex switching member against a biasing force of the duplex biasing member so as to form the third conveying path when the jam occurs.

6. An image forming apparatus comprising:

a transforming portion that is configured to transfer a toner image to a sheet;

a fixing portion that is configured to fix the toner image on the sheet;

a drawer portion that (a) is drawable from an apparatus body and (b) includes a first pair of conveying rollers which is disposed at a downstream side of the fixing portion in a sheet conveying direction and which conveys the sheet on which the toner image was fixed by the fixing portion;

a conveying portion that (a) is disposed in the apparatus body and (b) includes a pair of separating rollers which conveys the sheet received from the first pair of conveying rollers and which come in contact with and are separated from each other, the pair of separating rollers conveying the sheet by reverse rotation after conveying the sheet received from the first pair of conveying rollers by positive rotation;

a second pair of conveying rollers that receives the sheet conveyed by the reverse rotation of the pair of separating rollers and conveys the sheet; and a controller that controls operations of the drawer portion and the conveying portion such that: the pair of separating rollers are separated from each other when a jam of a sheet occurs in a state in which (i) a preceding sheet is nipped by the pair of separating rollers and (ii) a subsequent sheet subsequent to the preceding sheet spans the drawer portion and the conveying portion, and the first pair of conveying rollers conveys the subsequent sheet to a part between the pair of separating rollers up to a position at which the subsequent sheet does not span the drawer portion and the conveying portion.

7. The sheet conveying apparatus according to claim 6, wherein the conveying portion comprises a reverse conveying portion including a reverse switching member that switches a conveying path of the sheet received from the drawer portion, conveying the received sheet in a switchback manner via the reverse switching member by positively or reversely rotating the pair of separating rollers, and inverting front and rear sides of the sheet.

8. The sheet conveying apparatus according to claim 7, wherein the controller controls such that the pair of separating rollers conveys a leading edge of the preceding sheet to the reverse switching member in a case that the preceding sheet is not conveyed to the reverse switching member after the preceding sheet is conveyed in the switchback manner at the time of occurrence of the jam.

9. The sheet conveying apparatus according to claim 7, wherein the reverse conveying portion includes:

a reverse biasing member that applies a force to the reverse switching member so as to form a second conveying path different from a first conveying path which guides the sheet received from the drawer portion to the pair of separating rollers; and a reverse switching portion that switches the reverse switching member against a biasing force of the reverse biasing member so as to form the first conveying path when the jam occurs.

10. The sheet conveying apparatus according to claim 9, wherein the reverse conveying portion further includes:

a duplex switching member that is disposed downstream in a sheet conveying direction from the pair of separating rollers and that switches the conveying path of the sheet received from the pair of separating rollers;

a pair of reversing rollers that conveys the received sheet in a switchback manner via the duplex switching member by positive rotation or reverse rotation;

a duplex biasing member that applies a force to the duplex switching member so as to form a fourth conveying path different from a third conveying path which guides the sheet received from the pair of separating rollers to the pair of reversing rollers; and a duplex switching portion that switches the duplex switching member against a biasing force of the duplex biasing member so as to form the third conveying path when the jam occurs.

11. An image forming apparatus comprising:

a transforming portion that is configured to transfer a toner image to a sheet;

a fixing portion that is configured to fix the toner image on the sheet;

a drawer portion that is drawable from an apparatus body; and a conveyer that conveys the sheet in the drawer portion and the apparatus body, wherein the conveyer includes:

(1) a first pair of conveying rollers which is (a) disposed at a downstream side of the fixing portion in a sheet conveying direction and (b) conveys the sheet on which the toner image was fixed by the fixing portion;

(2) a pair of separating rollers that (a) is disposed in the apparatus body, (b) includes a first roller and a second roller, and (c) is switched to a nipped state in which the sheet can be nipped between the first roller and the second roller and a separated state, a distance between a center of the first roller and a center of the second roller in the separated state being longer than a distance between the center of the first roller and the center of the second roller in the nipped state; and (3) a second pair of conveying rollers that receives the sheet conveyed by reverse rotation of the pair of separating rollers and conveys the sheet, wherein when a jam of the sheet occurs, (a) the conveyer conveys a sheet spanning the drawer portion and the apparatus body to a part between the first roller and the second roller of the pair of separating rollers in the separated state by the first pair of conveying rollers and (b) the conveyer conveys the sheet between the first roller and the second roller of the pair of separating rollers up to a position at which the sheet does not span the drawer portion and the apparatus body.

12. The sheet conveying apparatus according to claim 11, wherein the pair of separating rollers conveys the sheet in a switchback manner by positive rotation or reverse rotation.

13. The sheet conveying apparatus according to claim 12, wherein the conveyer comprises a reverse conveying portion including a reverse switching member that switches a conveying path of the sheet received from the drawer portion, conveys a leading edge of a preceding sheet to a reverse switching member using the pair of separating rollers when the preceding sheet is not conveyed to the reverse switching member after the preceding sheet is conveyed in the switchback manner at the time of occurrence of the jam.

14. The sheet conveying apparatus according to claim 11, wherein the first pair of conveying rollers is disposed in the drawer portion.

15. The sheet conveying apparatus according to claim 14, wherein after the sheet is conveyed to between the first roller and the second roller of the pair of separating rollers in the separated state, the pair of separating rollers are switched to the nipped state and the sheet is conveyed to a position at which the sheet does not span the drawer portion and the conveying portion using the pair of separating rollers.

16. The sheet conveying apparatus according to claim 11, wherein the sheet between the first roller and the second roller of the pair of separating rollers in the separated state is conveyed to a position at which the sheet does not span the drawer portion and the conveying portion using the first pair of conveying rollers.

17. The sheet conveying apparatus according to claim 11, wherein when a preceding sheet is nipped by the pair of separating rollers in the nipped state and a jam of the sheet occurs in a state in which a subsequent sheet subsequent to the preceding sheet spans the drawer portion and the apparatus body, the pair of separating rollers are switched to the separated state and the subsequent sheet is conveyed to between the first roller and the second roller of the pair of separating rollers in the separated state using the first pair of conveying rollers.

* * * * *